US009746291B1

(12) United States Patent
Crawford

(10) Patent No.: US 9,746,291 B1
(45) Date of Patent: Aug. 29, 2017

(54) MULTIPURPOSE SHOOTING PLATFORM TARGET AND STAND

(71) Applicant: Garrett Crawford, Colorado Springs, CO (US)

(72) Inventor: Garrett Crawford, Colorado Springs, CO (US)

(73) Assignee: Garrett Crawford, Colorado Springs, CO (US)

( * ) Notice: Subject to any disclaimer, the term of this patent is extended or adjusted under 35 U.S.C. 154(b) by 0 days.

(21) Appl. No.: 15/281,342

(22) Filed: Sep. 30, 2016

(51) Int. Cl.

| | |
|---|---|
| ***F41J 1/10*** | (2006.01) |
| ***F41J 5/18*** | (2006.01) |
| ***F41J 7/00*** | (2006.01) |
| ***F41J 5/24*** | (2006.01) |

(52) U.S. Cl.
CPC . *F41J 5/18* (2013.01); *F41J 1/10* (2013.01); *F41J 5/24* (2013.01); *F41J 7/00* (2013.01)

(58) Field of Classification Search
CPC ..... F41J 1/00; F41J 1/10; F41J 7/04
USPC ..... 273/403–410, 390–392
See application file for complete search history.

(56) References Cited

U.S. PATENT DOCUMENTS 910,608 A * 1/1909 Thompson et al. ..... F41J 7/04 273/391
1,348,442 A * 8/1920 Prebble ..... F41J 7/04 273/390
3,647,214 A * 3/1972 Hohmann ..... F41J 11/00 273/392
4,244,569 A * 1/1981 Wong ..... A63B 69/0071 273/389
4,614,345 A * 9/1986 Doughty ..... F41J 7/04 273/381
4,917,388 A * 4/1990 Marquardt ..... F41J 7/04 273/392
5,263,721 A * 11/1993 Lowrance ..... F41J 7/04 273/383
6,347,798 B1 * 2/2002 Quiring ..... F41J 7/04 273/391
7,427,069 B2 * 9/2008 Bateman ..... F41J 1/10 273/406
7,644,927 B2 * 1/2010 Law ..... F41J 1/10 248/215
8,910,943 B2 * 12/2014 Lee ..... F41J 1/10 273/392

(Continued)

*Primary Examiner* — Mark Graham
(74) *Attorney, Agent, or Firm* — Williams Intellectual Property; Benjamin F. Williams

(57) ABSTRACT

A multipurpose shooting platform target and stand devised for use in training with large caliber, high, and hyper velocity weaponry includes a target plate dependable from a frame member by hooked engagement between a cylindrical member and a rearward mount. The rearward mount is disposed upon a reverse surface of the target plate. Engagement with the cylindrical member of the frame member effects orientation of the target plate under the influence of gravity to rest at an acute angle relative an underlying surface. Impact of ballistics against an obverse surface of the target plate effects movement of a lowermost edge of the target plate rearwards, and impacted rounds are readily deflected in controlled trajectories downwards towards the underlying surface without danger of ricochet in unpredictable patterns. Swing of the target plate signals impact of the obverse surface to a shooter.

5 Claims, 6 Drawing Sheets

(56) References Cited

U.S. PATENT DOCUMENTS

| | | | | |
|---|---|---|---|---|
| 2008/0272548 | A1* | 11/2008 | Hensley | F41J 1/10 273/406 |
| 2013/0001880 | A1* | 1/2013 | Dean | F41J 1/10 273/407 |
| 2015/0268013 | A1* | 9/2015 | Heise | F41J 7/04 273/389 |

* cited by examiner

MULTIPURPOSE SHOOTING PLATFORM TARGET AND STAND

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of multipurpose shooting platform targets and high velcoty ballistic targets are known in the prior art. Care must always be taken to secure the target to a stand while enabling controlled deflection of rounds after impact with the target surface to avoid dangerous ricochets. Moreover, means of securing a target to a raised stand or other structure must not present hard metal parts or other features where impact with a high velocity (or hyper velocity) round might cause shattering and dangerous spray of shrapnel or another elastically rebounded fragments.

What is needed is a multipurpose shooting platform target and stand that secures to a post member above a ground surface by action of a rearward mount, said rearward mount fused to a reverse surface of a target plate, whereby possibility of hitting the rearward mount from an anteriorly oriented firing direction is impossible. The rearward mount enables pivotal swing of the target plate when impacted by a round, and simultaneously prevents the target plate from dislocating from the stand. Thus impact of the target is visually cued to a shooter and controlled deflection of impacted rounds rearwards, towards an underlying ground surface, is maintained.

FIELD OF THE INVENTION

The present invention has been devised for use in training special operations personnel familiar with high velocity and hyper velocity ballistics, use of long range firearms, large caliber weapons, and other state of the art, high and hyper velocity weaponry. The present invention has been devised to enable multipurpose target practice, enabling controlled deflection of impacted rounds, even at high calibers and velocities, fired from an anterior shooting direction relative an obverse surface of a target plate. Shooters firing high velocity ballistics from raised situations, such as from a helicopter, for example, as well as structurally situated shooters or ground based shooters, are thereby enabled safe practice targeting the present invention.

The present multipurpose shooting platform target and stand further prevents dangerous ricochets, shattering, or spray from a target surface by concealing a rearward mount from the anterior shooting direction, whereby impact of a round with any other surface or object but the obverse surface of the target plate is preventable. Secure, pivotal attachment of the rearward mount to a frame member enables raised situation of the target plate for targeting, without presenting any securing structures anteriorly in view (which may include high integrity metals for tensile strength and maintenance of target integrity) for potential impact with a fired round. Swing of the target plate at impact absorbs kinetic energy and controllably deflects impacted rounds rearwards and towards an underlying ground surface.

The present invention, therefore, relates to a multipurpose shooting platform target and stand, and more particularly, to a multipurpose shooting platform target and stand that includes at least one target plate having a rearward mount welded to a reverse surface thereof. The rearward mount slidably engages around a cylindrical member endwise disposed horizontally upon a frame member, said frame member disposed to secure overtop a post member securable vertically seated in a base plate assembly.

The target plate self-orients to rest at an acute angle relative an underlying ground surface by suspension upon the rearward mount hooked to the cylindrical member. The rearward mount, cylindrical member, and frame member are concealed behind the target plate and therefore obviated from any trajectory of rounds fired toward the obverse surface of the target plate.

Impact of a high velocity ballistics, therefore, effects defleciton of an impacted round off the target plate toward the ground surface without possibility of impact with any means of securement of the target plate above the ground surface. Movement of the target plate at impact with a fired round visually cues impact to a shooter. The target plate is prevented from toppling or disconnecting from the cylindrical member by contact of a lowermost edge of the target plate with the post member or with the frame member, whereby inversion of the target plate is preventable.

The target plate is nonetheless readily and expediently removable from engagement with the frame member. The rearward mount is dislocatable from the cylindrical member by lifting the target plate upwardly and anteriorly, towards the direction of fire. Thus, impact of ballistics from an anterior firing direction will not displace the target plate from the frame member or off the post member.

SUMMARY OF THE INVENTION

The general purpose of the multipurpose shooting platform target and stand, described subsequently in greater detail, is to provide a multipurpose shooting platform target and stand preventative of dangerous ricochets, elastic rebounds, or fragmentation of rounds as uncontrolled spray or shrapnel subsequent impact of high velocity ballistics with a target plate, while enabling securable position and reposition of the target plate expediently between shoots.

The present multipurpose shooting platform target and stand has been devised for training Special Operations personnel familiar with high and hyper velocity rounds, and large caliber rounds, used in long distance and mechanically housed weapons, as well as for other ballistic and tactical training exercises.

Targets present hazards when means for securement are exposed anteriorly facing the direction of fire. Rounds impacting securement portions, parts, or devices, which devices are often made of metal or other high-integrity materials, can fragment, fracture, rebound, or ricochet in dangerously unpredictable patterns. The present invention obviates these potential hazards and presents a securable target plate in an appropriate position for use with even large caliber and high and hyper velocity weapons training while ensuring appropriate deflection in controlled, rearward trajectories towards an underlying ground surface.

The present multipurpose shooting platform target and stand, therefore, includes a base plate assembly having a top surface and a bottom surface. The base plate assembly may be securable to an underlying surface or ground surface by action of at least a pair of anchors disposed to engage with the underlying surface and secure the base plate assembly in position. Each of the pair of anchors may comprise a stake member or screw member or other member devised to securely fasten to an underlying or adjacent structure whereby the base plate assembly is securable in a desired position and able to sustain impact with high and hyper velocity projectiles.

At least one seat member is disposed in the top surface of the base plate assembly. The at least one seat member orients an open topped structure into which a post member is endwise securable in an upended situation by action of at least one securement member. The at least one securement member is devised to extend interiorly into the at least one seat member to engage against the post member inserted therein and maintain vertical orientation of the post member securely fastened interior to the at least one seat member.

The post member is an elongate device having a foot, devised for securement interior to the seat member, and a head distally disposed endwise atop said post member. The post member is contemplated to be rendered of yielding material whereby elastic rebound or ricochet of rounds thereagainst is preventable. In the example embodiment herein depicted, the post member is made of wood. In the example embodiment herein depicted, the post member is a standard two-by-four piece of lumber, readily available and expediently replaceable as needed.

A frame member is disposed to mount to the head of the post member. The frame member includes a cap portion configured to seat overtop the head of the post member. The cap member includes an upper end, disposed to abut apically atop the head of the post member, and a lower end. A horizontal strut member is disposed anteriorly outfacing from the upper end along a horizontal axis, said horizontal strut member endwise terminating in connection with a cylindrical member disposed perpendicularly in a horizontal plane thereat. An angled strut member is disposed between the cylindrical member where connected with the horizontal strut member, and the lower end of the cap portion of the frame member. A pair of disc members is disposed endwise delimiting the cylindrical member.

A target plate is releasably securable in hooked engagement to the cylindrical member. The target plate includes an uppermost edge, a lowermost edge, an obverse surface, and a reverse surface. A rearward mount is disposed upon the reverse surface of the target plate, to which rearward mount the cylindrical member readily engages. The rearward mount includes a first hook bracket and a second hook bracket. The second hook bracket is disposed in parallel relation relative the first hook bracket. Each of the first and second hook brackets include a base portion and an arced portion disposed perimetrically bounding a rearwardly open aperture. Each of the first and second hook brackets, therefore, readily accommodate the cylindrical member within each rearwardly open aperture, whereby the target plate is dependable from the cylindrical member by engagement with the rearward mount.

The rearward mount is disposed upon the reverse surface of the target plate in a position more proximal the uppermost edge. When depended from the cylindrical member, the target plate, under the influence of gravity, therefore comes to balance at an incline, whereby the obverse surface of the target plate is disposed at an acute angle relative an underlying ground surface. The target plate is prevented from inverting when impacted due to contact effected between the lowermost edge and the post member, or, alternately, contact between the reverse surface and the frame member.

Impact with high and hyper velocity rounds from an anteriorly situated shooting direction, therefore, effects movement of the target plate lowermost edge rearward towards the post member. Impacted rounds are deflected downwards, towards the underlying ground surface. Energy of the round is exhausted in impacting the target plate, acceleration of the mass of the target plate may approximate the kinetic energy of the particular round in use. Thus particular target plates, of varying mass, are contemplated as part of this invention, devised for use with particular weaponry, as case may be. Additional weight may be added in some embodiments to the reverse surface, for example depended at the rearward mount, whereby increased kinetic energy is required to accelerate the target plate in downswing—that is, effecting swing movement of the target plate whereby the lowermost edge is moved rearwardly and the obverse surface of the target plate is cause to incline more steeply relative an underlying ground surface. In either event, the lowermost edge of the target plate is prevented from rearwards movement further than the post member.

Target plates are readily interchangeable. A user simply lifts the target anteriorly to disengage each of the first and second brackets. The present multipurpose shooting platform target and stand, therefore, enables expedient manufacture, erection, and interchange of relevant parts between shoots. Further, by design, impact of rounds with any other part of the present multipurpose shooting platform target and stand than the obverse surface of the target plate or potentially exposed portions of the post member, is readily preventable, whereby controlled and predictable deflection of impacted rounds is repeatedly and safely maintained.

Thus has been broadly outlined the more important features of the present multipurpose shooting platform target and stand so that the detailed description thereof that follows may be better understood and in order that the present contribution to the art may be better appreciated.

For better understanding of the multipurpose shooting platform target and stand, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
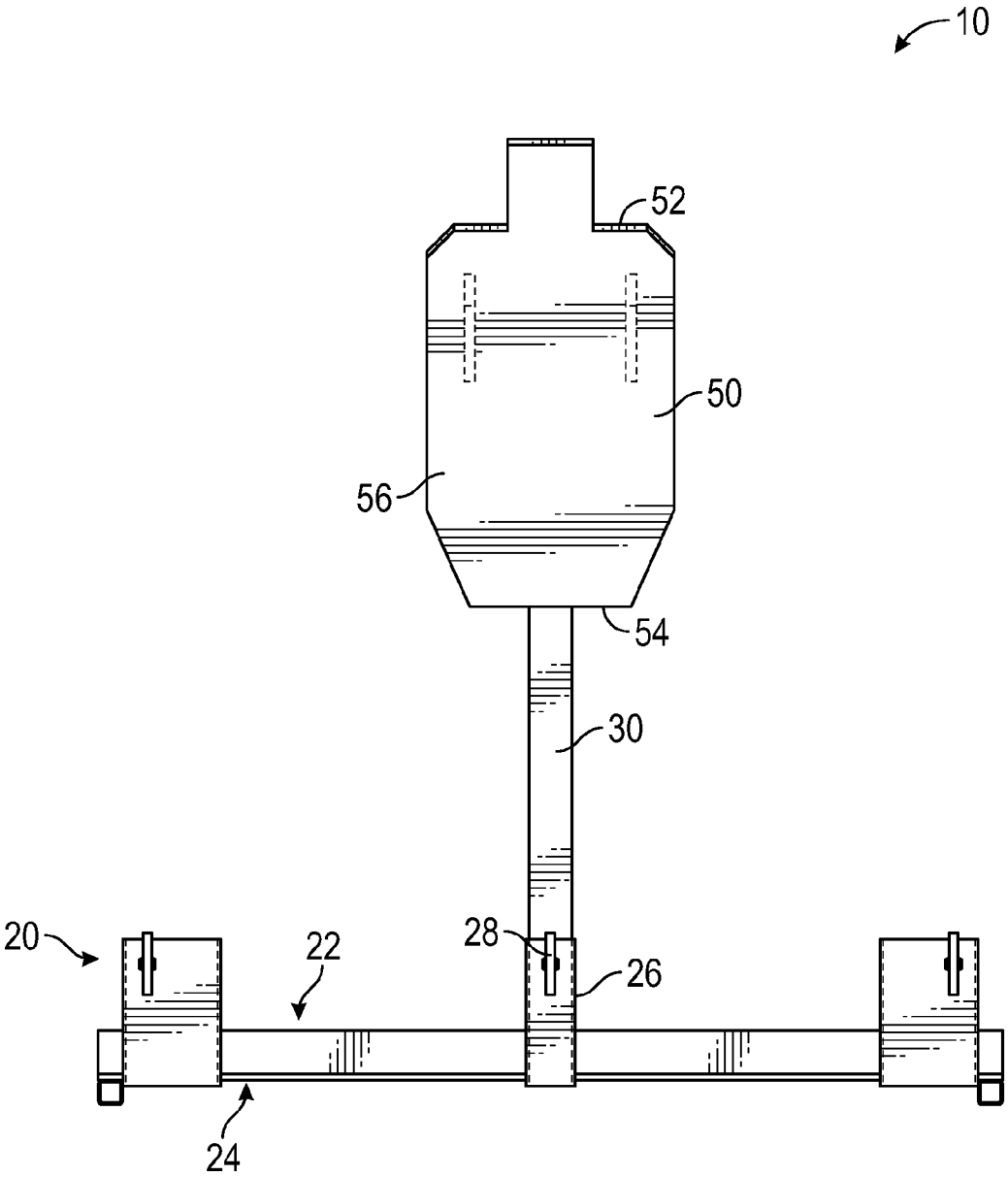
FIG. 1 is a front elevation view of an example embodiment.
Figure 2:
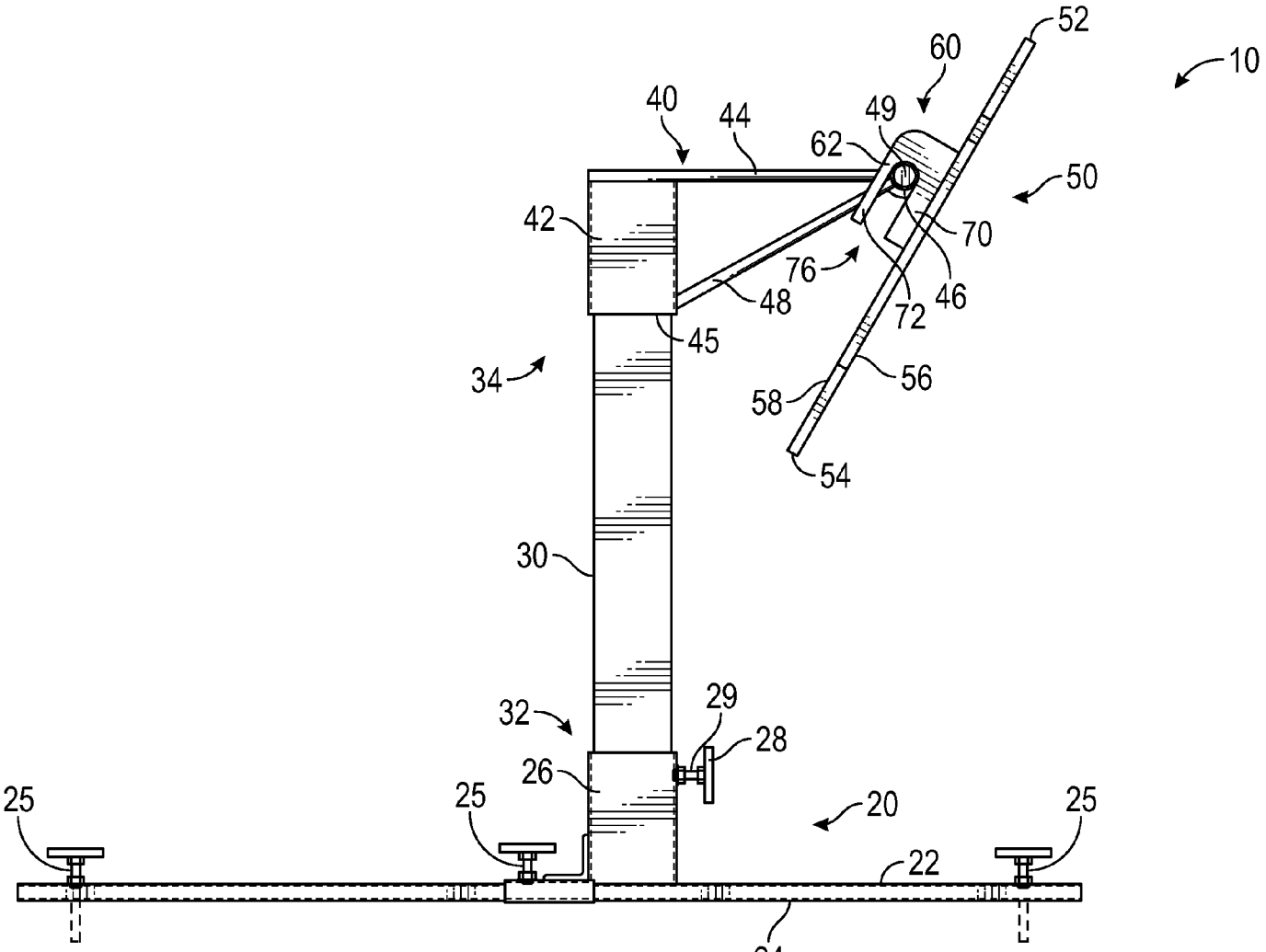
FIG. 2 is a side elevation view of an example embodiment.
Figure 3:
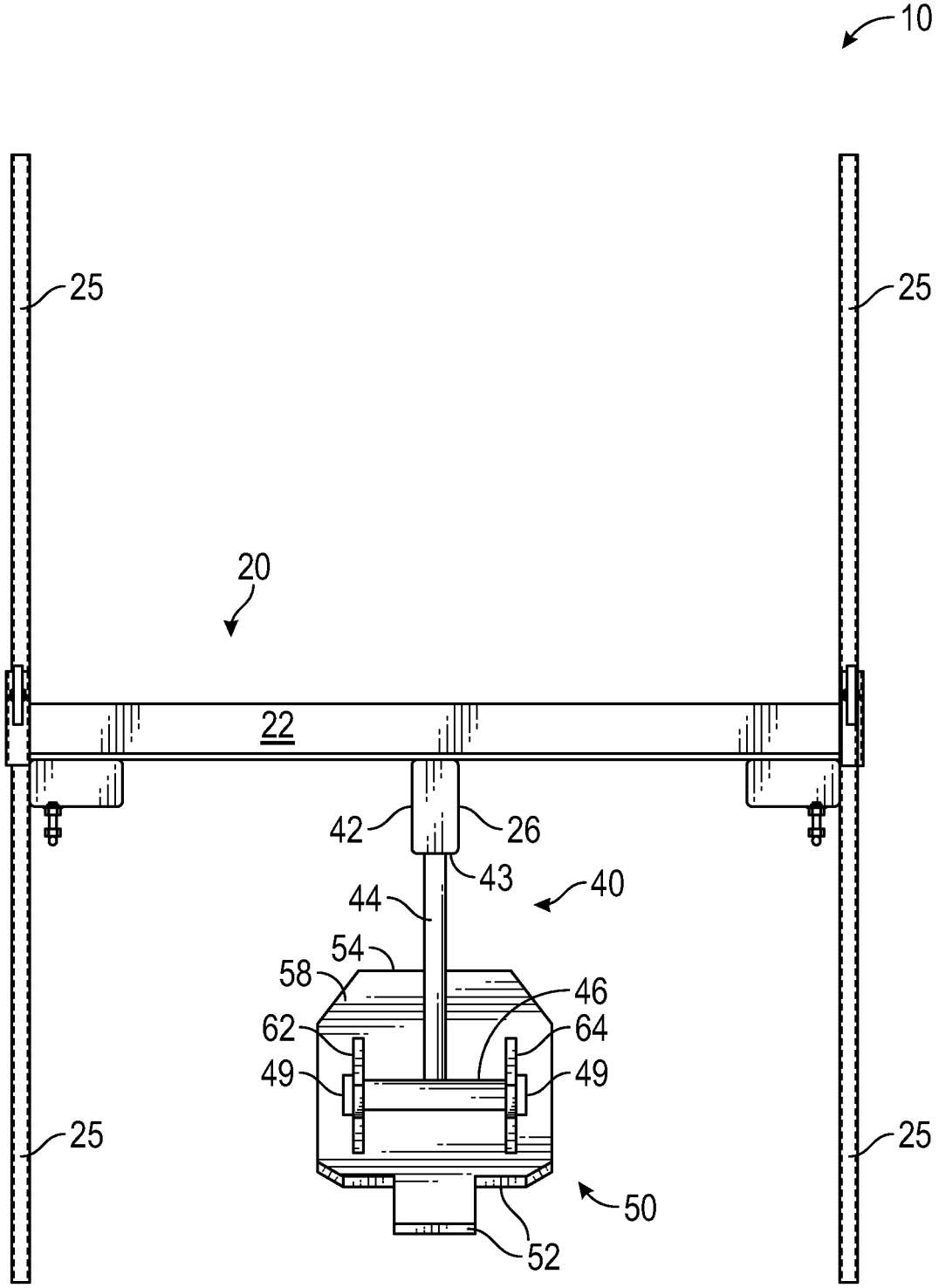
FIG. 3 is a top elevation view of an example embodiment.
Figure 4:
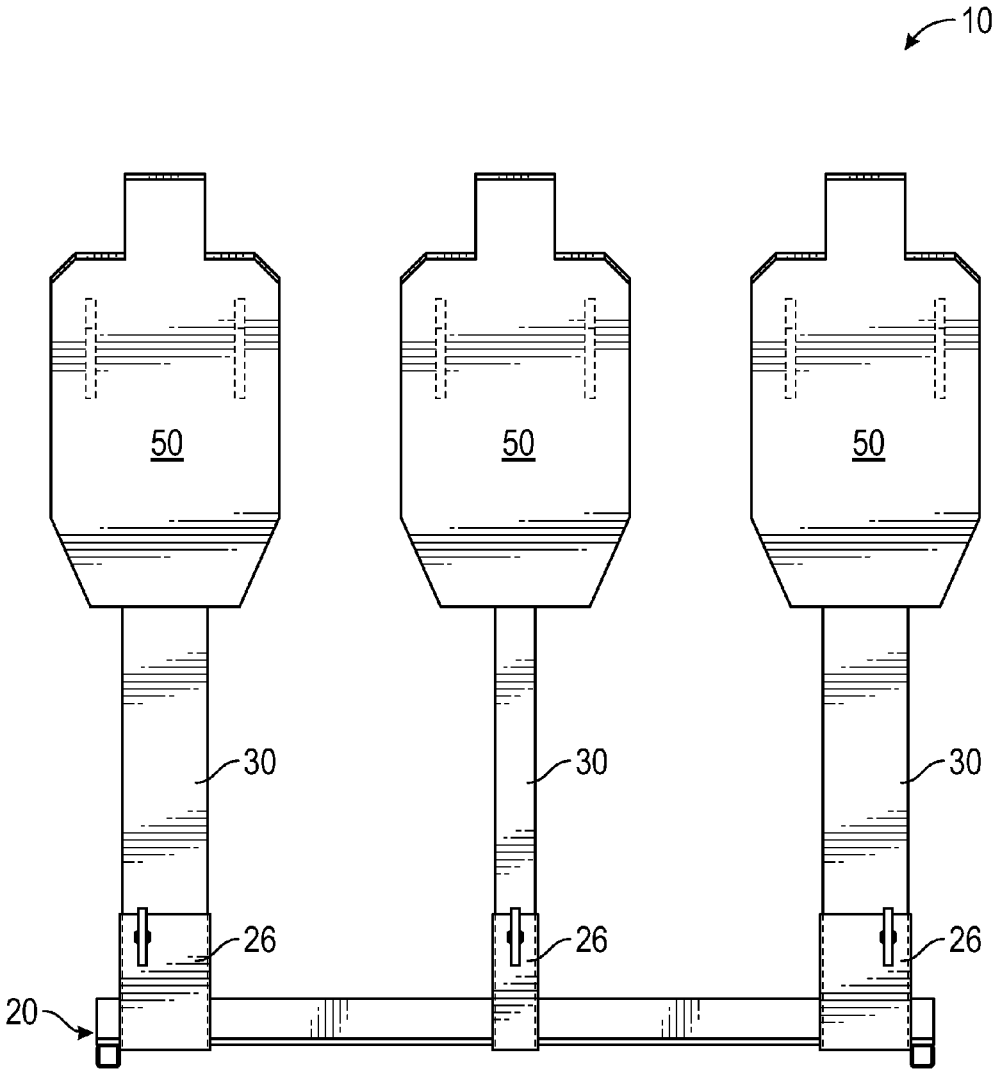
FIG. 4 is a front elevation view of an example embodiment.
Figure 5:
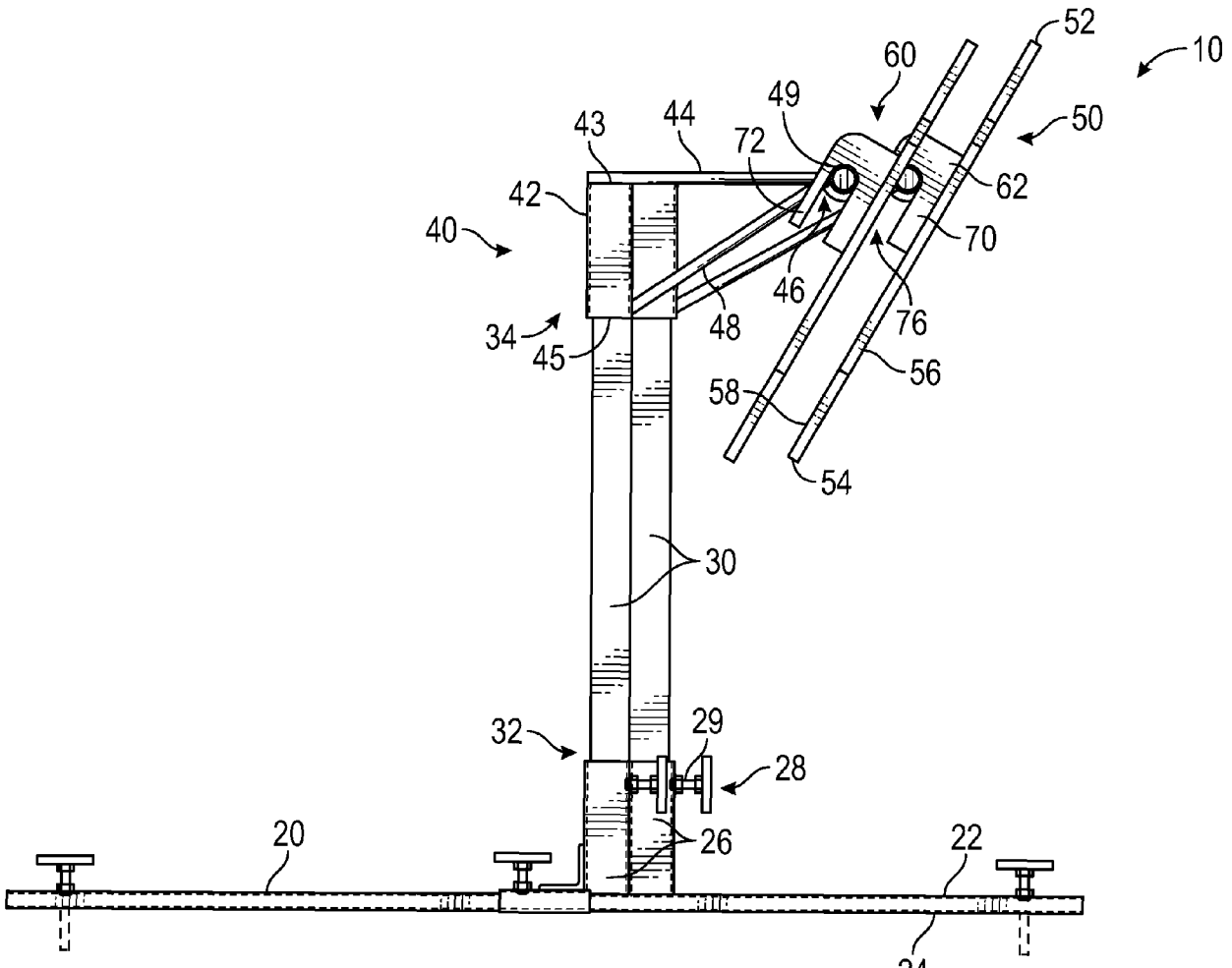
FIG. 5 is a side elevation view of an example embodiment.
Figure 6:
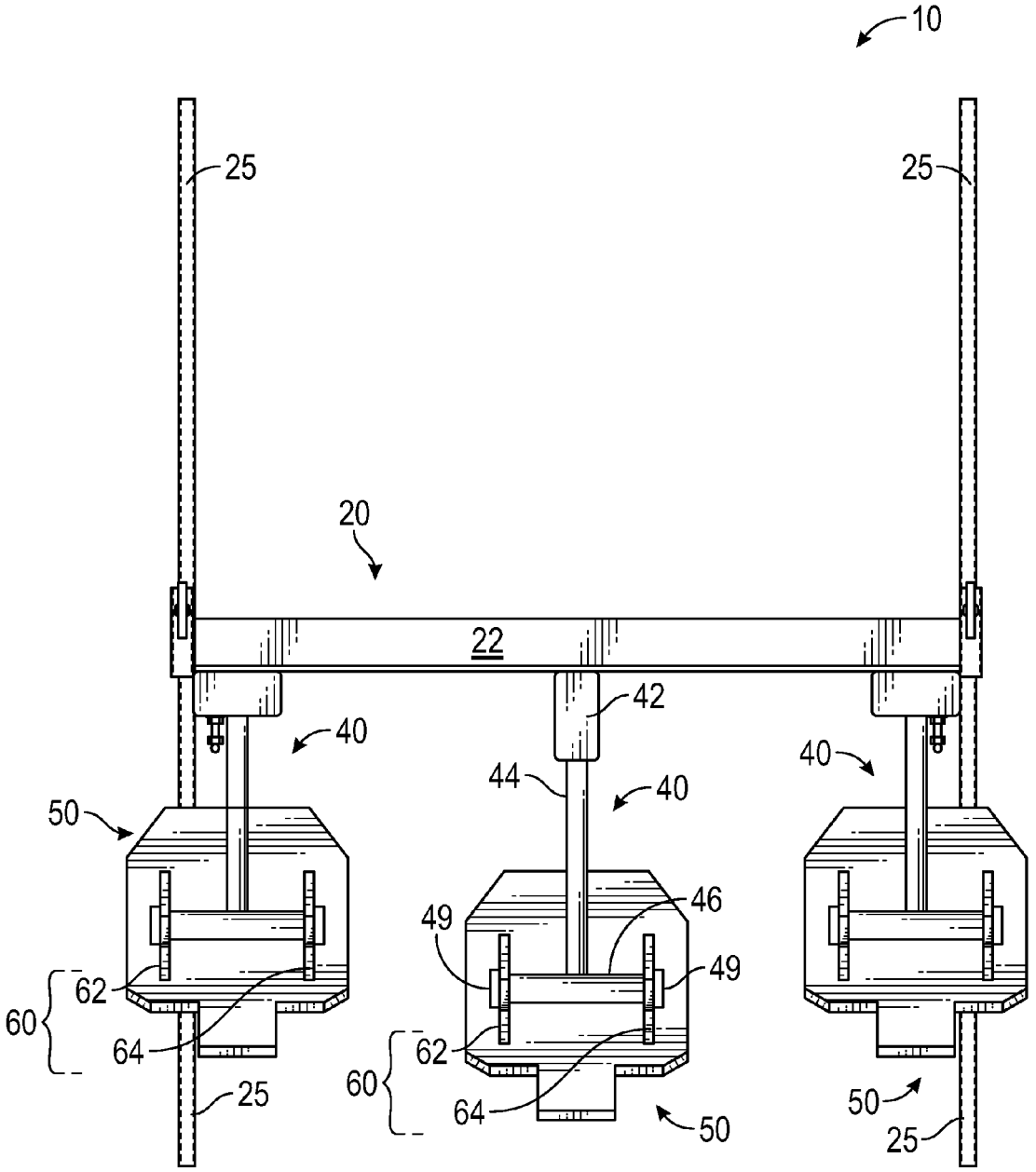
FIG. 6 is a top elevation view of an example embodiment.

With reference now to the drawings, and in particular FIGS. 1 through 6 thereof, example of the instant multipurpose shooting platform target and stand employing the principles and concepts of the present multipurpose shooting platform target and stand and generally designated by the reference number 10 will be described.

Referring to FIGS. 1 through 6 a preferred embodiment of the multipurpose shooting platform target and stand 10 is illustrated.

The present multipurpose shooting platform target and stand 10 has been devised to enable controlled deflection of ballistics off an obverse surface 56 of a target plate 50 while enabling a simple means of attachment of said target plate 50 to a post member 30 without rivets or other means of attachment that may present additional surfaces from which ballistics can inadvertently ricochet, fracture, fragment, rebound, or otherwise uncontrollably deflect subsequent impact therewith. Moreover, the present multipurpose shooting platform target and stand 10 is usable with large caliber, high velocity, and hyper velocity ballistics to readily control deflection subsequent impact and visually cue impact by downswing of the target plate 50.

The multipurpose shooting platform target and stand 10, therefore, includes a base plate assembly 20, a post member 30, a frame member 40, and a target plate 50, readily erectable and securable together to control deflection of ballistics from impact with the target plate 50, as will be described subsequently.

The base plate assembly 20 includes a top surface 22 and a bottom surface 24 and may be secured to an underlying surface by action of anchors 25 endwise disposed upon the base plate assembly 20 for engagement into an underlying surface. In the example embodiment depicted herein, the anchors 25 are screw bolts.

At least one seat member 26 is disposed in the top surface 22 into which the post member 30 is endwise securable by action of a securement member 28 disposed to effect securement interior to the at least one seat member 26 by action of a screw clamp 29 extendible into the seat member 20. The base plate assembly 20 may include more than one seat member 20, in the example embodiment illustrated in FIG. X the base plate assembly 20 includes three seat members 26, disposed to securely orient three separate post members 30 to which separate frame members 40 and target plates 50 are securable.

The post member 30 is disposed to secure endwise into the seat member 26 when the securement member 28 is engaged thereagainst. The post member 30 is preferably made of a nonmetallic, yielding material, such as wood for example, whereby impact by stray ballistics will not enable elastic rebound therefrom. The post member 30 includes a foot 32 securable into the seat member 26 and a head 34 distally disposed atop the post member 30. The post member 30 is contemplated to be readily replaceable. In the example embodiment depicted herein the post member 30 is a standard two-by-four piece of lumber.

The frame member 40 is securable atop the post member 30. The frame member 40 includes a cap portion 42 disposed to insert overtop the post member 30 head 34, said cap portion 42 having an upper end 43 and a lower end 45. A horizontal strut member 44 is anteriorly projected from the cap portion 42 upper end 43. A cylindrical member 46 is disposed perpendicularly along a horizontal plane endwise upon the horizontal strut member 44. An angled strut member 48 is disposed between the cylindrical member 46 and the cap portion 42 lower end 45. Each of a pair of disc members 49 delimit each end of the cylindrical member 46.

The target plate 50 is removably connectable to engage about the cylindrical member 46 and self-orient under the influence of gravity to rest at an acute angle relative the underlying ground surface. The target plate 50 includes an uppermost edge 52, a lowermost edge 54, an obverse surface 56, and a reverse surface 58. A rearward mount 60 is welded to the target plate 50 reverse surface 58 more proximal the uppermost edge 52. Position of the target plate 50 with the rearward mount 60 engaged around the cylindrical member 46 effects orientation of the target plate 50 into the acute angle relative the underlying ground surface because a greater portion of the target plate 50 is disposed downwardly extended beyond the rearward mount 60. The target plate 50 is thus unbalanced in vertical orientation when suspended upon the cylindrical member 46, and finds a balanced position at an acute angle relative the underlying ground surface.

The rearward mount 60 includes a first hook bracket 62 and a second hook bracket 64 disposed to connect overtop the cylindrical member 46 by hooked engagement therewith. Each of said first and second hook brackets 62, 64 includes a base portion 70 welded to the target plate 50, an arced portion 72 disposed in parallel relation with the base portion 70, and a rearwardly open aperture 76 delimited by the base portion 70 and the arced portion 72. Thus the rearward mount 60 slides over the cylindrical member 46 and enables pivotal action of the target plate 50 into an acute angle effected by the weight of the target plate 50 under the influence of gravity suspended on the frame member 40.

The target plate 50 thus removably connects to the cylindrical member 46 by hooked engagement of each of the first and second hook brackets 62, 64 thereto in position in between each of the pair of disc members 49. The target plate 50 is preventable from endwise dislocation from the cylindrical member 46 by contact with each of the pair of disc members 49. To remove the target plate 50, a user must lift the target plate 50 upwards to slide each of the first and second hook brackets 62, 64 off the cylindrical member 46, or alternately pull the target plate 50 when angled in an anterior direction, toward the direction of fire. Thus, impact even high or hyper velocity ballistics prevents dislocation of the target plate 50 during use.

The target plate 50 also absorbs energy of impacting rounds by pivoting the lowermost edge 54 towards the post member 30. The acceleration of the mass of the target plate 50 against the influence of gravity thereby transfers kinetic energy of the impacting round to the target plate 50, and the rearward swing of the target plate 50 directs deflection of the impacted round rearwards, towards the ground surface.

Contact of the lowermost edge 54 with the post member 30 (or in alternate embodiments, contact of the reverse surface 58 with the angled strut member 48, or other part of the frame member 40) prevents the target plate 50 from inverting and dislocating from the cylindrical member 46. Thus controlled deflection of impacted ballistics directs rounds towards the ground surface and swing movement of the target plate 50 visually cues an impact to the shooter.

What is claimed is:

1. A multipurpose shooting platform target and stand comprising:

a base plate assembly comprising:

at least one seat member having at least one securement member disposed to extendibly secure against a post member endwise inserted upended into said at least one seat member;

a frame member securable apically atop the post member, said frame member having:

a horizontally disposed cylindrical member endwise projected from a cap portion;

an upper end apically delimiting the cap portion;

a lower end basally delimiting the cap portion;

a horizontal strut member anteriorly projected from the cap portion upper end, said horizontal strut supporting the cylindrical member perpendicularly along a horizontal plane endwise thereupon;

an angled strut member disposed between the cylindrical member and the cap portion lower end;

each of a pair of disc members disposed at each end of the cylindrical member; and a target plate removably connectable to the cylindrical member by hooking engagement of a rearward mount disposed upon a reverse surface of said target plate, said rearward mount disposed more proximal an uppermost edge of the target plate than a lowermost edge of the target plate enabling self-orientation of the target plate to rest under the influence of gravity at an acute angle relative an underlying ground surface;

wherein deflection of ballistics impacting an obverse surface of the target plate is controllable and directable towards the underlying ground surface.

2. The multipurpose shooting platform target and stand of claim 1 wherein the rearward mount of the target plate further comprises a first hook bracket and a second hook bracket, each of said first and second hook brackets including:

a base portion welded to the target plate;

an arced portion disposed in parallel relation to the base portion; and a rearwardly open aperture delimited by the base portion and overtop by the arced portion.

3. The multipurpose shooting platform target and stand of claim 2 wherein the post member is a standard-sized piece of lumber.

4. The multipurpose shooting platform target and stand of claim 3 wherein the base plate assembly includes three seat members to position three target plates upon three post members.

5. A multipurpose shooting platform target and stand comprising:

a base plate assembly comprising:

a top surface;

a bottom surface;

a seat member disposed in the top surface;

a securement member disposed to effect securement interior to the at least one seat member;

a post member disposed to secure endwise into the seat member when the securement member is engaged thereagainst, said post member comprising:

a foot securable in the at least one seat member;

a head distally disposed atop the post member;

a frame member securable atop the post member, said frame member comprising:

a cap portion disposed to insert overtop the post member head, said cap portion having an upper end and a lower end;

a horizontal strut member anteriorly projected from the cap portion upper end;

a cylindrical member disposed perpendicularly along a horizontal plane endwise upon the horizontal strut member;

an angled strut member disposed between the cylindrical member and the cap portion lower end;

each of a pair of disc members disposed at each end of the cylindrical member; and a target plate removably connectable to the cylindrical member, said target plate comprising:

an uppermost edge;

a lowermost edge;

an obverse surface;

a reverse surface;

a rearward mount disposed welded to the target plate reverse surface more proximal the uppermost edge, said rearward mount comprising a first hook bracket and a second hook bracket connectable overtop the cylindrical member, each of said first and second hook brackets comprising:

a base portion welded to the target plate;

an arced portion disposed in parallel relation to the base portion; and a rearwardly open aperture delimited by the base portion and by the arced portion;

wherein the target plate connects to the cylindrical member by hooked engagement of each of the first and second hook brackets thereto in position in between each of the pair of disc members, and the target plate self-orients at an acute angle relative an underlying ground surface when suspended from the cylindrical member, whereby impact of ballistics effects controlled deflection of said ballistics off the obverse surface downwardly toward an underlying ground surface and movement of the target plate visually cues an impact to a shooter without risk of dangerously rebounded ballistics or disconnection of the target plate from the cylindrical member.

* * * * *